United States Patent [19]

Buck et al.

[11] Patent Number: 4,608,841

[45] Date of Patent: Sep. 2, 1986

[54] KNITTING MACHINE HAVING A NEEDLE BED

[75] Inventors: Alfred Buck, Rottenburg; Falk Kühn, Kiebingen, both of Fed. Rep. of Germany

[73] Assignee: Memminger GmbH, Freudenstadt, Fed. Rep. of Germany

[21] Appl. No.: 634,789

[22] Filed: Jul. 26, 1984

[30] Foreign Application Priority Data

Aug. 24, 1983 [DE] Fed. Rep. of Germany ..... 3330530

[51] Int. Cl.[4] ..... D04B 15/06

[52] U.S. Cl. ..... 66/104; 66/106

[58] Field of Search ..... 66/104, 106, 107

[56] References Cited

U.S. PATENT DOCUMENTS

| | | | |
|---|---|---|---|
| 1,114,539 | 10/1914 | Scott | 66/104 X |
| 1,255,259 | 2/1918 | Wilcomb | 66/106 X |
| 2,073,595 | 3/1937 | Lawson et al. | 66/107 |
| 2,329,617 | 9/1943 | Ingalls | 66/106 |
| 4,532,781 | 8/1985 | Buck | 66/104 |

FOREIGN PATENT DOCUMENTS

| | | | |
|---|---|---|---|
| 2047401 | 3/1972 | Fed. Rep. of Germany | 66/106 |
| 2642079 | 3/1978 | Fed. Rep. of Germany | 66/106 |
| 3,108,041 | 9/1982 | Fed. Rep. of Germany | 66/104 |

*Primary Examiner*—Wm. Carter Reynolds

*Attorney, Agent, or Firm*—Frishauf, Holtz, Goodman & Woodward

[57] ABSTRACT

In a knitting machine having at least one needle bed, the needle bed is equipped with needles located beside one another, which are guided in a longitudinally displaceable manner under the control of a needle cam race. Combined hold-down and knock-over sinkers that are movable both in the longitudinal direction of the needles and transversely thereto are pivotably supported between the needles, their longitudinal and transverse movement being controlled by sinker cam race surfaces.

In order to attain satisfactory, relatively low-friction guidance of the needles and sinkers while operating at high speed, the apparatus is designed such that the needles are disposed on longitudinal ribs disposed spaced apart on the needle bed, and the sinkers are disposed between these ribs. The needles are laterally guided, over an upper portion of their shank length near the needle cheek, by the sinkers, while over the remaining lower portion of their shank length they are guided by auxiliary ribs disposed beside the longitudinal ribs and joined to the needle bed.

5 Claims, 11 Drawing Figures

KNITTING MACHINE HAVING A NEEDLE BED

The invention relates to a knitting machine having at least one needle bed, which is equipped with a plurality of needles located beside one another and movable between projected and retracted positions under the control of a needle cam. Combined hold-down and knock-over sinkers disposed between the needles and slidable in the longitudinal direction of the needles and substantially transversely thereto are supported on an associated fulcrum in the vicinity of their shank such as to rock about a horizonal axis. The sliding movement of the sinkers is controlled by surfaces of the sinker cam race.

BACKGROUND

A knitting machine of this kind, such as that described in U.S. application Ser. No. 438,890, filed Oct. 21, 1982, now Pat. No. 4,532,781, to which German Patent Disclosure Document No.DE-OS 31 08 041 corresponds, is distinguished by a high operating speed. The hold-down and knock-over sinkers are moved longitudinally, counter to the needle casting-off movement, after the operation of latch clearing or holding down has been performed, or in other words during the actual process of loop formation. As a result, the distance the needles must travel during the casting-off movement becomes correspondingly shorter, so the needle cam race can be embodied with a less steeply inclined surface. This makes it possible to increase the knitting speed substantially. The transverse movement of the sinkers with respect to the associated needles that takes place after the holding down operation serves to move the sinkers into the correct position for knocking over. After the loop forming process has ended, when the needle is again projected, the corresponding sinkers are returned to the initial position, counter to the projection movement of the needles; in so doing, the sinkers are first moved transversely to the needles so as to hold down the half-finished row of loops and prevent the goods from being pulled along with the needles as they are projected.

The longitudinal sliding movement of the combined hold-down and knock-over sinkers is effected via control butts disposed on the ends of the sinker shanks, which cooperate with associated sinker cam races disposed in a cam box below the needle cam race. A further circumferential sinker cam race of tapering cross section is disposed above the needle cam race; it is traced by corresponding noses, disposed such as to protrude laterally on the sinker shanks, in order to generate the transverse movement of the hold-down and knock-over sinkers, the fulcrum of which is disposed on the end of the sinker shank carrying the control butt.

In this knitting machine, the sinker shanks directly embody the guide ribs for the needle shanks, producing a very fine needle cut, the minimum limit of which is dictated only by the thickness of the hold-down and knock-over sinkers.

Since the surfaces of the sinker cam race, which in cooperation with the control butts generate the longitudinal movement of the sinkers, are located below the needle cam race, the hold-down and knock-over sinkers must have relatively long shanks. If patterning devices are associated with the needles, then a plurality of needle cam races disposed one above the other must be used, cooperating with the correspondingly arranged butts of the various types of needles required in that case. This means that more space is then required, which in turn dictates a further lengthening of the sinker shanks.

However, long sinker shanks produce a considerable amount of frictional heat as they move, and dispersing this heat can become problematic in machines that operate at very high speed. Furthermore the forces of acceleration and deceleration that arise with the sinkers, which have relatively great masses, become undesirably large.

The same basic situation exists in a knitting machine operating on the same principle and disclosed in U.S. patent application Ser. No. 559,495, filed Dec. 8, 1983, now U.S. Pat. No. 4,546,623, by Kuhn and Buck, which is part of the prior art here and in which each of the hold-down and knock-over sinkers has a shank embodied as a two-armed lever. This shank is supported on the needle bed on a fulcrum with a crosswise axis, and two sinker cam race surfaces are provided on both sides of the fulcrum, each acting on one of the lever arms. With these surfaces, it is possible to generate a transverse movement of the head of the hold-down and knock-over sinker in one direction by means of one surface and in the opposite direction by means of the other. Once again, in this knitting machine, the sinker cam race surface that generates the longitudinal movement of the sinkers, like one of the sinker cam race surfaces that generates the transverse movement of the sinker head, is located below the needle cam race, so that once again the sinker shanks have a relatively great length.

In knitting machines operating with hooked sinkers for spreading apart and taking on the latest loops formed at a particular time, it is known (German Patent Disclosure Document No. DE-OS 29 09 963) to dispose the sinker cam race surfaces above the needle cam race, thereby resulting in a relatively short length for the shanks of the hooked sinkers, which are pivotable about a horizontal axis at a fulcrum. The hooked sinkers have a transporting hook that extends in the longitudinal direction of the shank, and the section that bears the transporting hook is joined to the shank via a resilient part. The sinkers are supported on the associated needle shank, which in turn is laterally guided between ribs of the needle cylinder. The hooked sinkers, which are pressed with spring biassing against the backs of the needle shanks, again generate considerable friction, however, and also place a strain on the needle shanks, which can cause problems in very high-speed machines.

THE INVENTION

It is an object of the present invention to devise a knitting machine which operates at very high speed and is distinguished by satisfactory, relatively friction-free guidance of the needles and of the hold-down and knock-over sinkers, while at the same time the mass of the combined hold-down and knock-over sinkers is reduced in comparison with the prior art, structures while making it possible to provide patterning devices for the needles, and without making the sinker shanks any longer.

Briefly, the sinkers are located such that the sinker cam races are positioned between the needle hook and the uppermost needle cam race; in other words, the sinker cam races are positioned between the needle butt and the needle hook. The needle bed is formed with spaced ribs on which the needles are slidably positioned. Lateral guidance for the needles is effected by auxiliary needle guide strips located on the needle bed, adjacent the needles, and extending for a portion of the length of the needles through a guide zone terminating at a level of the needles between the needle cam race and the hook, and positioned close to the needle cam race. Lateral guidance of the needles between that terminating level of the auxiliary guide strips and the needle hooks is provided by the sinkers themselves, which are located adjacent the needles in the region between the hook and the portion of the shaft above the level at which the zone defined by the auxiliary guide strips terminates.

The sinkers can be moved to slide up and down and, additionally, can be rocked about an axis transverse to the sliding movement by suitable shaping of sinker cams positioned in the region of the needles between the needle butts, that is, the needle cams and the needle hook, or head.

Because the needle cam race is located below the surfaces of the sinker cam races, any of the conventional needle selectors (patterning devices) can readily be used, without affecting the length of the sinker shanks. The needles run on the longitudinal ribs, and in their lower portion, that is, in the region of the butt, they are laterally guided by the auxiliary guide ribs, or strips, that are disposed on the needle bed in a stationary manner. It is thereby attained that there is no frictional, heat-producing coupling between the needle and sinker shanks executing independent longitudinal movements in the region of the needle butts which puts particular strain on the guides. Above the auxiliary strips, the hold-down and knock-over sinkers, now embodied with a rather short shank, simultaneously act as guide ribs in the region of the needle cheek or throat, where the lateral strain on the guides is no longer so great that excessive heat generation would be a source of anxiety.

The construction is simplified if each auxiliary strip resting laterally on the associated longitudinal rib is rigidly connected thereto. The auxiliary strips themselves may be of tapering cross section, such that the needle guidance grooves which they form are defined with substantially parallel flanks. This results in particularly good lateral guidance of the needles.

The hold-down and knock-over sinkers may each have a bearing projection, disposed such as to protrude laterally, on their shank embodied as a two-armed lever; with this projection, the sinkers are supported on the needle bed above the auxiliary strips and a fulcrum is embodied thereby. The arrangement may, however, also be such that the sinkers are embodied in two parts, with one substantially L-shaped rocking element and one substantially straight shank element; in that case, the rocking element has on one of its arms a laterally protruding bearing projection with which the rocking element is supported on the needle bed, a fulcrum being embodied thereby, while the shank element is guided in a longitudinally displaceable manner on the arm of the rocking element bearing the projection and has a butt that cooperates with the sinker cam race surface generating the longitudinal movement of the sinkers. The sinker cam race surfaces generating the transverse movement of the sinkers are disposed above the auxiliary strips at both sides of the fulcrum, such that they cooperate with the shank element and the rocking element.

This embodiment has the advantage that only very small masses must be moved in the course of the longitudinal movement of the sinkers, because the rocking element generating the rocking movement is not compelled to execute the longitudinal movement as well but instead is solely pivoted back and forth about its axis.

To further improve the situation in terms of friction, the projection may have a circular bearing surface, which engages a correspondingly shaped bearing recess of the needle bed in the manner of a ball joint.

The novel knitting machine makes it possible to use simple, short and non-massive hold-down and knock-over sinkers, which can be manufactured at a favorable cost. The frictional surfaces are reduced to a minimum while maintaining satisfactory guidance of the needles and the sinker shanks, which in turn reduces noise and heat, permitting still greater knitting speeds to be used.

DRAWING

DETAILED DESCRIPTION

Figure 1:
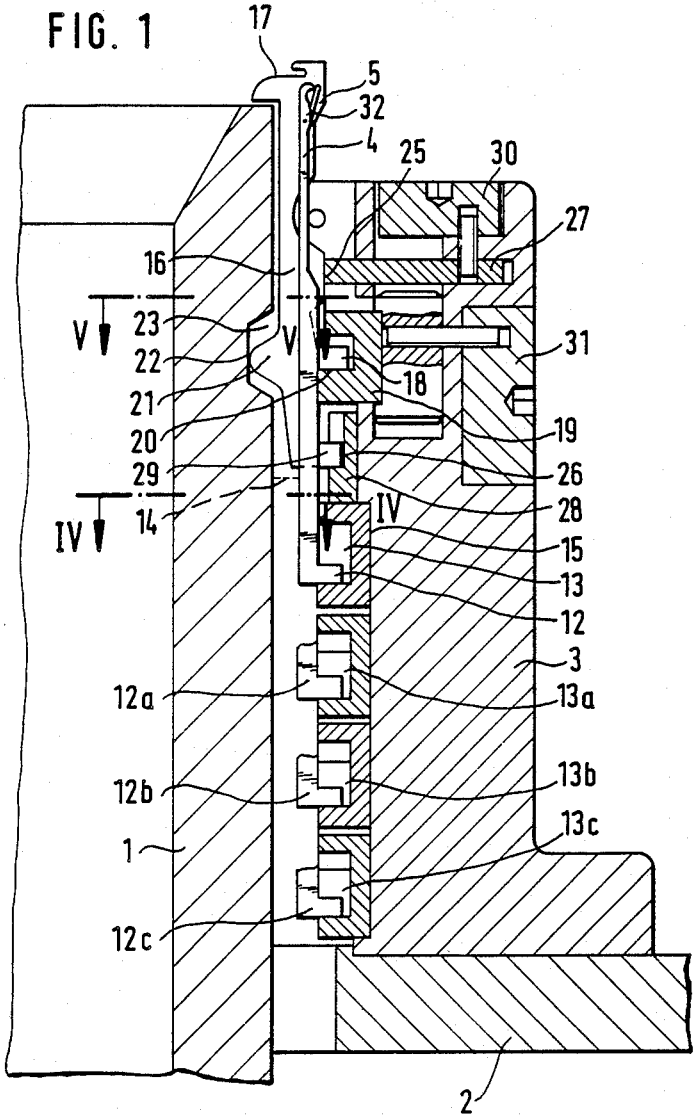
FIG. 1 is a schematic, fragmentary sectional side view of the invention, showing the needle cylinder, the cam box and one needle, as well as a combined hold-down and knock-over sinker.

The needle cylinder or bed 1 of the circular knitting machine is shown in FIG. 1. It is located on a stationary frame ring 2 such that it is rotatable in the conventional manner about a vertical axis and is set to rotating by a drive source, not shown. A cylindrical cam box 3 is secured on the frame ring 2, and on its end oriented toward the needle cylinder 1 it bears the control element for the latch needles shown at 4 and the combined hold-down and knock-over sinkers shown at 5.

As shown particularly in FIGS. 2–5, longitudinally extending radial grooves 6, into which longitudinal ribs 7 are inserted, are formed in the needle cylinder 1, spaced apart in the spacing of the division of the sinkers. Each longitudinal rib 7 is provided on its radially outward-facing side with a guide surface 8, on which a latch needle 4 is supported with its shank 11 in a longitudinally displaceable, or slidable, manner. Auxiliary ribs, or strips, 9 and 9' are secured to the longitudinal ribs 7, resting laterally on these ribs 7, but they extend over only part of the length of the longitudinal ribs 7 and are provided only in the lower portion of the needle cylinder 1 (see FIG. 3). The auxiliary ribs 9 have a rectangular cross section; ribs 9' have a tapering cross section, such that the needle guidance grooves 10' defined by two adjacent auxiliary ribs 9' are defined with parallel flanks. Ribs 9 and 9' can be used together (see FIG. 4).

The latch needles 4 are provided on their shanks with at least one butt 12 (FIG. 1), which engages a corresponding needle cam race 13, disposed on the inside of the cam box 3 and shaped to correspond to the associated needle cam contour; the needle cam race 13 controls the longitudinal movement of the needles 4.

Figure 2:
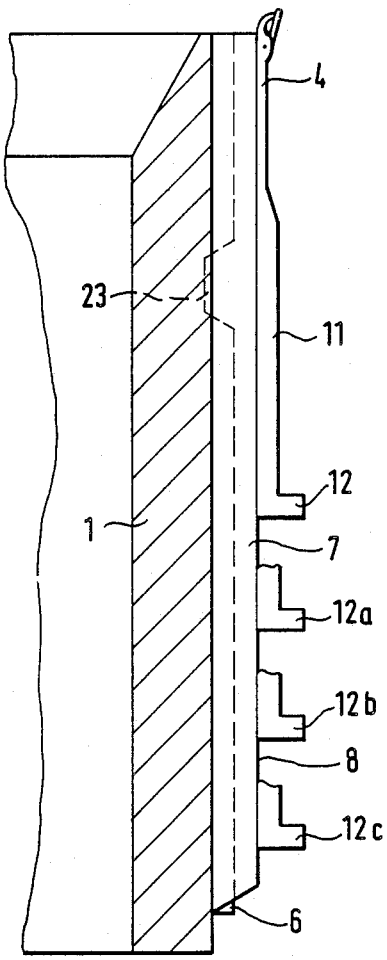
FIG. 2 shows the needle cylinder of FIG. 1 in an axial section viewed from the side, with the auxiliary ribs or strips omitted from the drawing.
Figure 3:
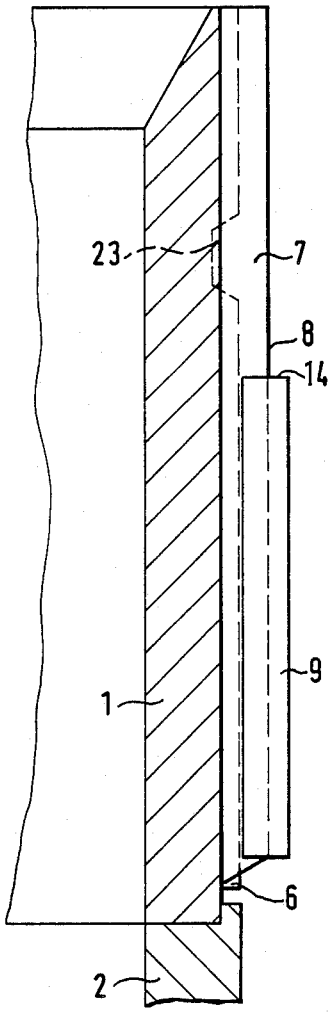
FIG. 3 shows the needle cylinder of FIG. 2, in a sectional view corresponding to FIG. 2 but with an auxiliary rib included.

As shown in FIGS. 1, 2, it is also possible for a plurality of needle cam races 13, 13*a*, 13*b*, 13*c* to be provided on the cam box, disposed one above the other and cooperating with corresponding butts 12, 12*a*, 12*b*, 12*c* of the needles 4, the shanks of which have different lengths, so that the individual needle types are associated with the individual needle cam contours 13–13*c*, as is known per se for the purpose of pattern selection.

The auxiliary ribs 9 terminate at level 14 (FIG. 1), somewhat above the needle cam element 15 defining the uppermost cam race 13. The sinkers 5 are disposed above the auxiliary ribs 9, and in the form of embodiment shown in FIGS. 1–8, the shanks 16 of the sinkers 5 are each formed as two-armed levers. Each sinker shank has a radially outwardly protruding sinker butt 18 on its end remote from the sinker head 17, and the first sinker butt 18 cooperates with a sinker cam race surface 20 formed on the inside of the cam box 3, in a sinker cam element 19. This surface 20 of the sinker cam race controls the longitudinal movement of the sinkers 5 that takes place in the longitudinal direction of the needles.

On the end remote from the sinker butt 18, each sinker shank has a protruding, approximately triangular bearing projection 21, which is supported with a rounded bearing surface 22 on the bottom of an annular groove 23 machined into the needle cylinder 1. Projection 21 forms a fulcrum; hence the sinker 5 is pivotable about an axis that is horizontal with reference to FIG. 1. The groove 23 is elongated (see FIGS. 1, 6) to permit the sinker to slide vertically independently of rocking about the fulcrum. In the course of this pivoting, or rocking, the sinker head 17 executes a reciprocating transverse movement directed substantially at right angles to the longitudinal movement of the needles.

This transverse or rocking movement is generated by second and third sinker cam race surfaces 25, 26, which are formed inside the cam box 3 on sinker cam elements 27, 28. One sinker cam element 28, with its sinker cam race surface 26, engages a control butt 29 of the associated sinker 5 below the bearing projection 21, and the other sinker cam element 27, with its sinker cam race surface 25, engages the shank 16 of the associated sinker 5 above the bearing projection 21. At least the upper sinker cam element 27 is radially adjustable via an eccentric adjusting mechanism 30 (see FIG. 1) which is actuatable from outside, while an eccentric adjusting mechanism 31 which is also actuatable from outside is provided for the axial adjustment of the sinker cam element 19 that generates the longitudinal movement of the sinkers. The two adjusting devices 30, 31 make it possible to adjust the longitudinal and transverse movements of the sinkers 5 appropriately to particular conditions. The races 25, 26 are spaced from first cam race 20 to permit sliding of the sinkers.

Figure 4:
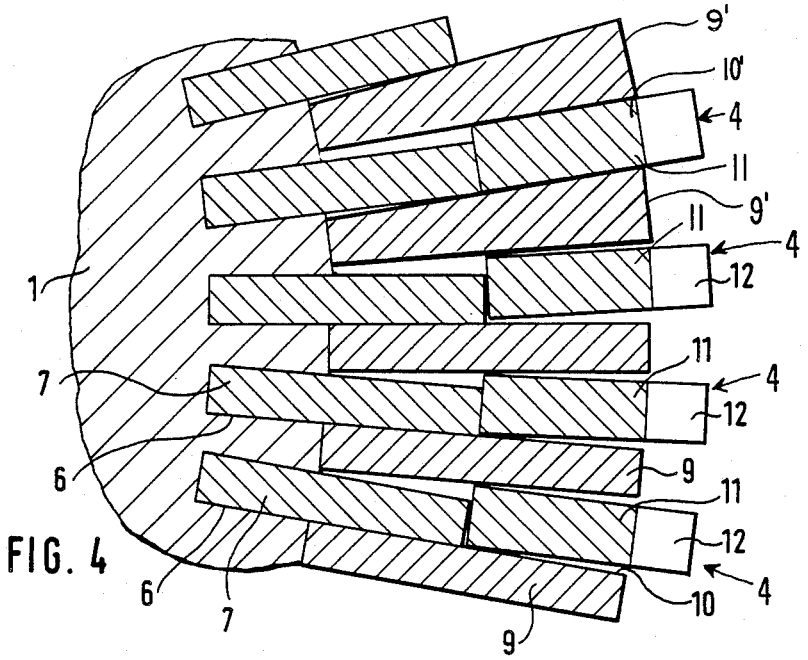
FIG. 4 shows the needle cylinder and needles as in FIG. 1, sectioned along the line IV—IV of FIG. 1, in a fragmentary plan view.
Figure 5:
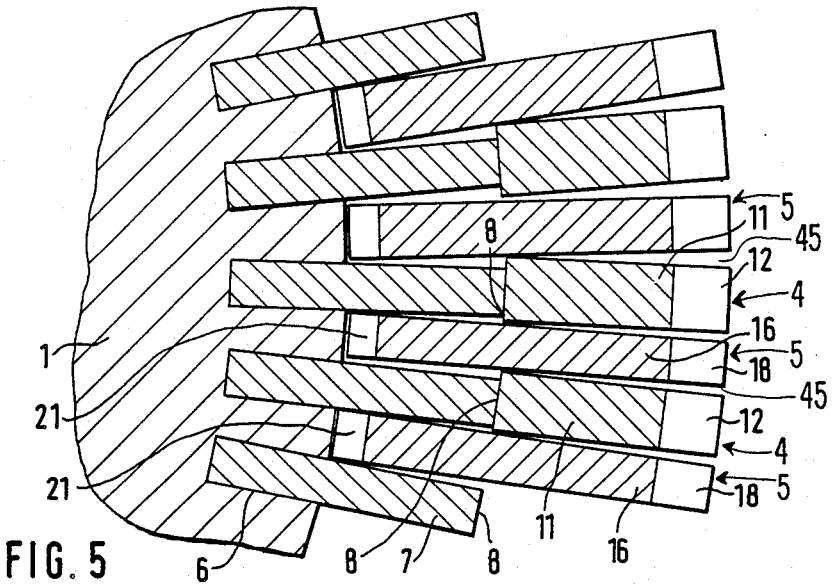
FIG. 5 shows the needle cylinder and needles of FIG. 1, sectioned along the line V—V of FIG. 1, in a fragmentary plan view.

As shown in FIGS. 4 and 5, in the region above the auxiliary ribs or strips 9 (FIG. 5), the needles 4 are thus laterally guided with their needle shanks 11 by the hold-down and knock-over sinkers 5 (FIG. 5), or more specifically by the sinker shanks 16, while in the region below this (FIG. 4), where the needle butts 12 are located, the lateral guidance of the needle shanks 11 is effected by the auxiliary ribs 9, in the manner already described. This insures that on the one hand, in the regions of increased tilting stress, that is, in the vicinity of the needle butts 12, the needles 4 have a rigid lateral guidance by means of the auxiliary ribs 9 that are joined to the needle cylinder 1, while on the other hand, satisfactory lateral guidance of the needle shanks 11 is also provided, even without the auxiliary ribs, in the upper zone, adjacent to the needle cheek 32 or needle throat.

The control of the projection and lowering movements of the latch needles 4, as well as of the longitudinal and transverse movement of the combined hold-down and knock-over sinkers 5 is described in detail elsewhere, for instance in U.S. Pat. No. 4,532,781 (German Patent Disclosure Document No. DE-OS 31 08 041) mentioned above. Accordingly, in FIGS. 6–8 only a few characteristic phases in movement are shown, to illustrate the guidance and bearing of the latch needles 4 and the sinkers 5.

Details of construction described in connection with FIG. 1 have been omitted for clarity from the drawings of FIGS. 6 to 11. Needle 4' (FIG. 6) differs from needle 4 (FIG. 1) by the butt arrangement; Rocker 5' (FIGS. 9–11) differs from the rocker 5 by being a two-part structure In FIG. 6, a latch needle 4 and the associated sinker 5'' are in the base position, and the loop of yarn caught in the needle hook is shown at 34. The needle shank 11' is elongated.

Figure 7:
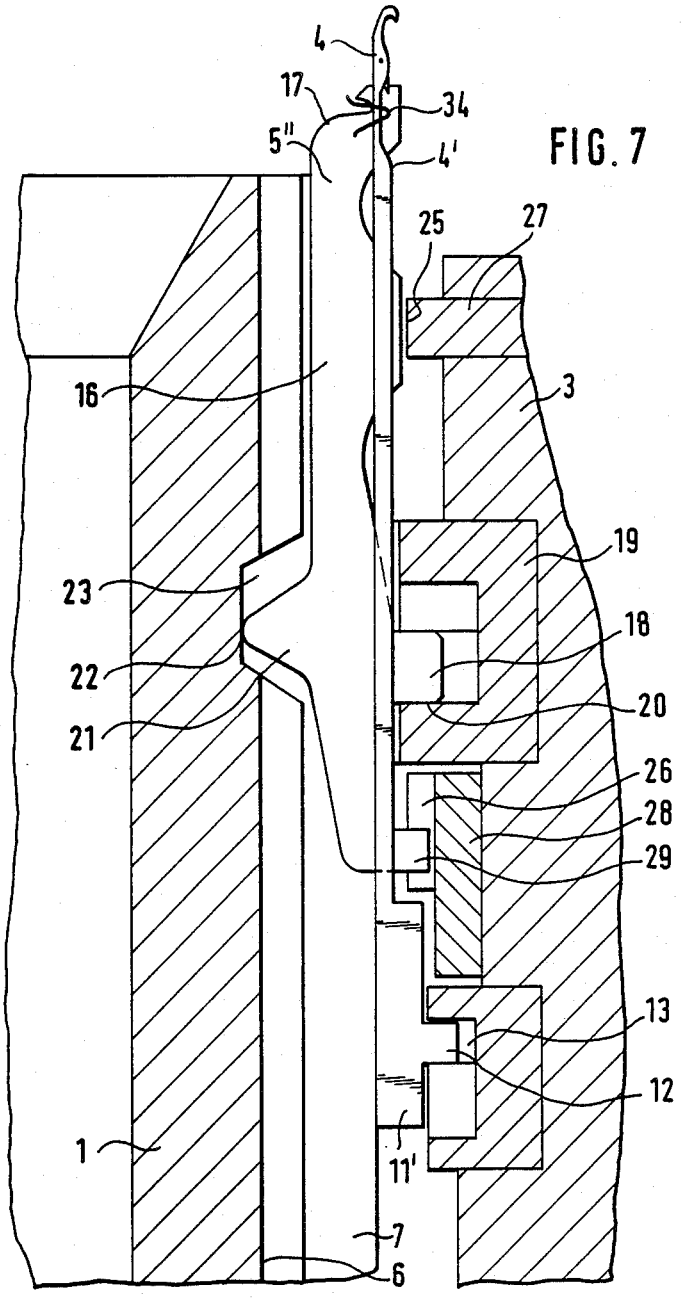
FIG. 7 shows the apparatus of FIG. 6 in a corresponding view, showing the situation where the needles and sinkers are in the hold-down or clearing position.

In FIG. 7, the latch needle 4' has been projected into the clearing position, while the sinker 5'' is beginning to be rocked radially inward by the upper sinker cam race surface 25, in order to restrain the loop 34 located in the needle hook.

Figure 8:
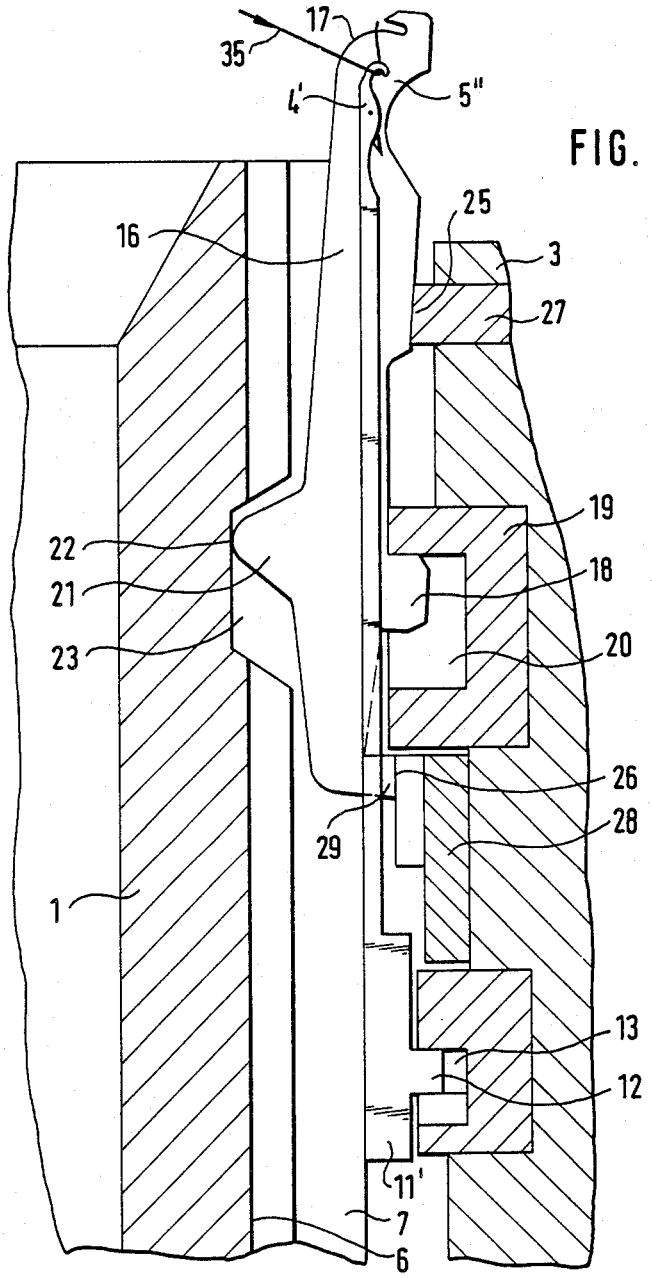
FIG. 8 shows the apparatus of FIG. 6 in a corresponding view, showing the situation in a predetermined yarn feeding position, in which yarn is being inserted into the needle to form a new loop.

In FIG. 8, new yarn 35 is being inserted into the latch needle 4', so as to form a new loop upon the lowering movement of the needle. The sinker 5'' executes a vertical movement upward at this time, in other words a longitudinal movement extending counter to the movement of the needle, and at the same time the sinker 5'', with its head 17, is pivoted radially outward by the sinker cam race surface 26. The pivoting or rocking movement of the sinker 5'' is effected about the fulcrum formed by the rounded bearing surface 22 on the bottom of the annular groove 23, and the bearing surface 22 is simultaneously displaced axially on the groove bottom, which is effected by means of the surface 20 of the sinker cam race of the sinker cam element 19.

Figure 6:
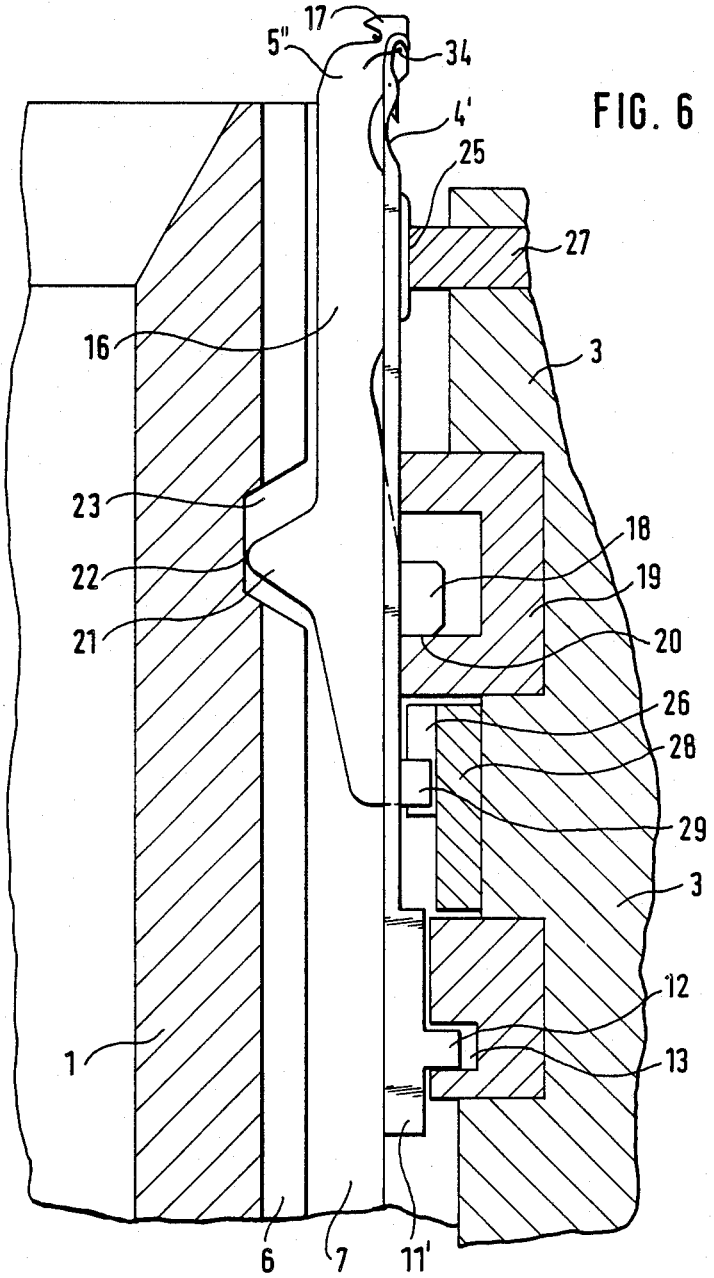
FIG. 6 shows a modified form of embodiment of the apparatus of FIG. 1, in an axial section seen from the side and showing the situation where the needles and sinkers are in their respective base positions.

From the position shown in FIG. 8, the sinkers 5'' and the latch needles 4' then return together, and parallel to one another, to the base position shown in FIG. 6. The radial projection of the needles 4, 4' as well as of the sinkers 5, at the circumference of the cylinder of a circular knitting machine will result in gaps 45 (FIG. 5) sufficiently wide to provide space for yarns 34, 35 to slide therebetween (see position of needle and sinker, FIGS. 7, 8 and 9, for example).

Figure 9:
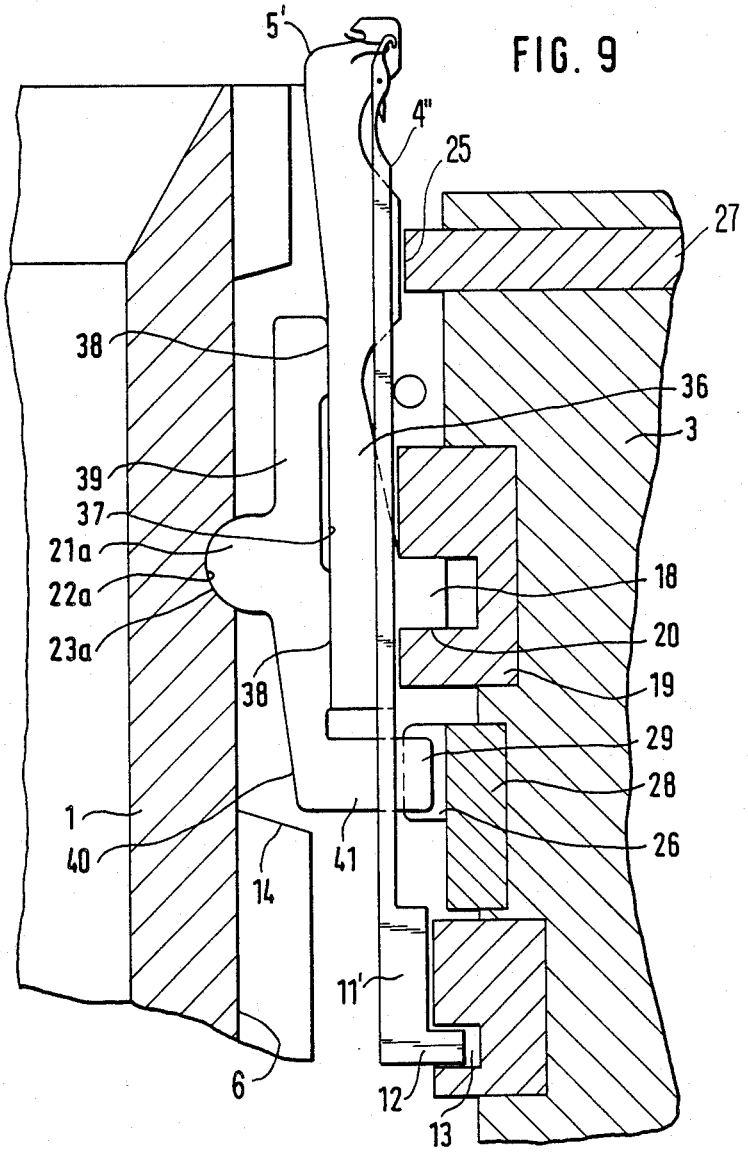
FIG. 9 shows the apparatus according to FIG. 1, in a further form of embodiment, in an axial section seen from the side.
Figure 10:
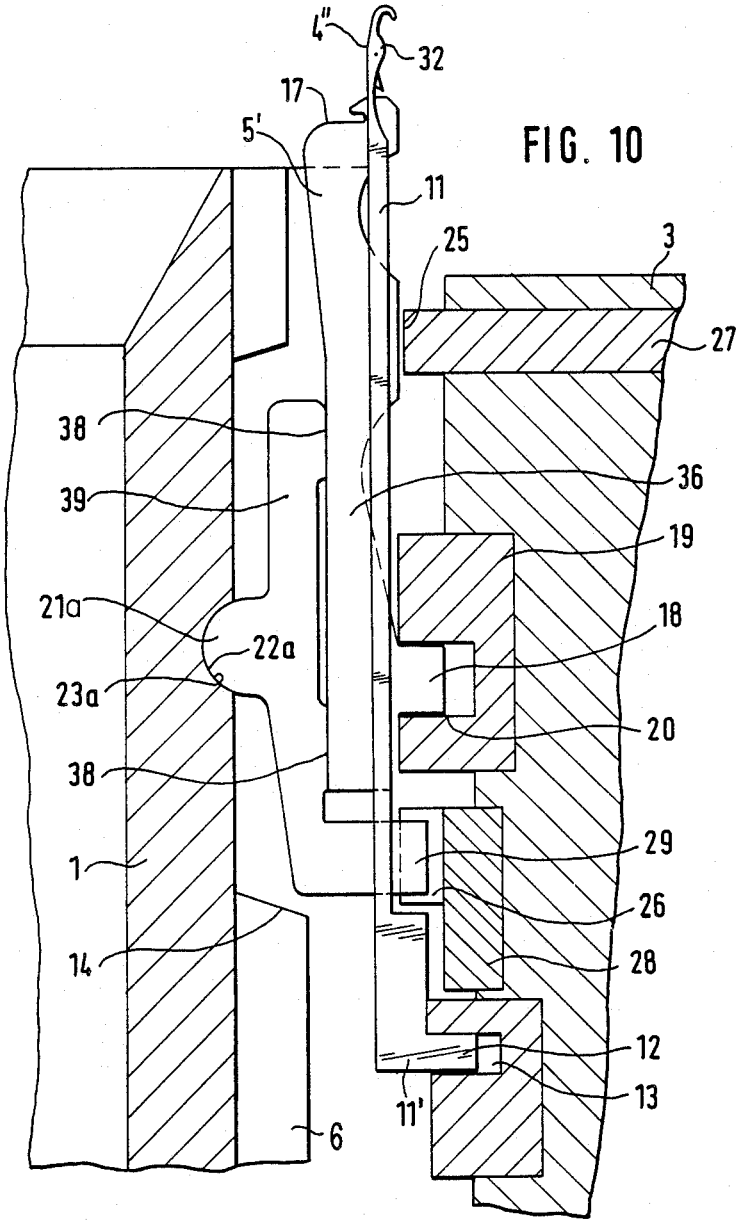
FIGS. 10, 11 show the apparatus according to FIG. 9, each in a corresponding view, showing the situation at two different moments during the loop forming process.
Figure 11:
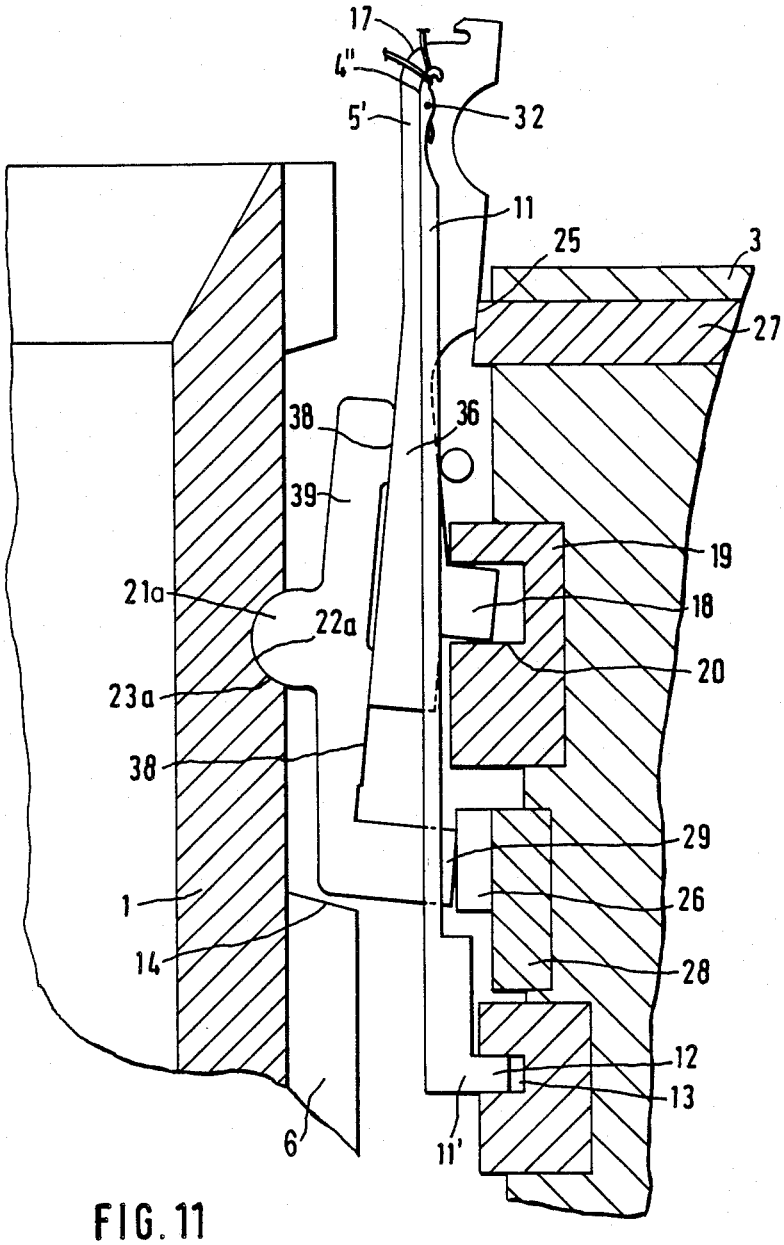

In the modified form of embodiment shown in FIGS. 9–11, elements similar to those in the form of embodiment shown in FIGS. 6–8 are identified with similar reference numerals, with prime notations, where desirable, and accordingly need not be described again here.

In this modified form of embodiment, sinkers 5 which are differently shaped are used. Another form of needle 4'' is illustrated Each of these sinkers 5 is embodied in two parts, having a substantially straight shank element 36 which is provided, on the end remote from the sinker butt 18, with a straight guide surface 37. With this guide surface 37, the shank element 36 rests on corresponding guide surfaces 38 of one arm 39 of a substantially L-shaped rocking element 40, the other arm 41 of which has the control butt 29.

On the end remote from the control butt, a laterally protruding bearing projection 21*a* is disposed on the arm 39 of the rocking element 40, this arm 39 again acting as a two-armed lever; the bearing projection 21*a* is substantially circular in shape and has a correspondingly circularly curved bearing surface 22*a*. With the bearing surface 22*a*, the bearing projection 21*a* is supported in an annular groove 23*a*, likewise approximately semicircular in cross section, in the needle cylinder 1 in the manner of a ball joint such that it is pivotable about a horizontal axis but is not axially displaceable.

As shown by the different phases of movement of the sinker 5' and of the associated latch needle 4'' illustrated in FIGS. 10, 11, the rocking element 40 effects only the rocking of the sinkers 5' and thus the transverse movement of the sinker head 17, but does not follow along with the longitudinal movement of the sinker 5'; its sliding engagement with the sinker via guide surfaces 37, 38 permits independent longitudinal and rocking movement of the sinker 5'. As a result, only very small masses need to be accelerated or decelerated in the course of the longitudinal movement.

In FIG. 9, the latch needle 4'', the sinker 5 and the rocking element 40 are shown in the base position, while in FIG. 10 the latch needle 4'' is projected into the clearing position, analogously to FIG. 7.

FIG. 11, finally, shows the latch needle 4'' and the sinker 5' in a position corresponding to FIG. 8. The radial rocking of the sinker 5' was generated via the control butt 29 of the rocking element 40 that cooperates with the lower sinker cam race surface 26, and the rocking element 40 was pressed with its arm 41 into a corresponding recess in the needle cylinder.

The longitudinal sinker movement was generated by the sinker butt 18, in cooperation with the sinker cam race surface in the sinker cam element 19, and the shank element 36 was pushed with its guide face 37 against the guide faces 38 of the rocking element 40.

The return, or rocking back, of the sinker 5' out of the position shown in FIG. 1 into the base position shown in FIG. 9 is effected by means of the upper sinker cam race surface 25, which directly engages the shank element 36 of the sinker 5'. During this operation, the lower sinker cam element 28 may be inoperative, or it may additionally serve as a counterpart guide for the rocking movement directed radially inward, during which the rocking element 40 is simultaneously returned to its base position.

We claim:

1. Knitting machine having a needle bed (1);

a plurality of needles (4) having needle shafts (11), needle butts (12) and hooks, located on the needle bed and movable between projected and retracted positions;

a needle cam box (3) having cam races (13) therein, engaging the needle butts of the needles and controlling needle movement;

combined hold-down and knock-over sinkers (5'), each having sinker butts (18) located between the needles and slidably movable between projected and retracted positions, and additionally movable in a rocking movement about an axis transverse to said sliding movement;

and sinker cam means (19) having first sinker cam races (20) engaging the sinker butts (18) to control said sliding movement, and second (25) and third cam races (26), selectively engaging the sinkers to control said rocking movement thereof, and wherein the sinker cam means are located to position the first, second and third sinker cam races (20, 25, 26) between the needle butt and the needle hook, and above the needle cam race (13);

the sinker cam means being further located to position the first sinker cam race (20), engaging the sinker butts (8) between, and spaced from the second and third sinker cam races (25, 26), to control, selectively, and independently from each other, longitudinal sliding movement of the sinkers (5') as well as rocking movement of the sinkers;

the needle bed is formed with spaced ribs (7) on which the needles are slidably positioned;

auxiliary needle guide strips (9) are provided, positioned, essentially in alignment with the sinkers, located on the needle bed (1), placed adjacent the needles to separate adjacent needles from each other defining at least a portion of a needle guide slot or groove (10) and extending through a zone terminating at a level between the needle cam race (13) and the hook, and close to the needle cam race, to provide for lateral guidance of the needles in said zone;

the sinkers (5') are located adjacent the needles (4) in the region thereof between the hook and the portion of the needle shafts (11) up to said level, and providing for lateral guidance of the needles (4) in said region;

the sinkers (5') are each formed in two parts, including a substantially L-shaped rocking element (40) having two arms (39,41) and a substantially straight shank element (36), a laterally protruding bearing projection (21a) being formed on the rocking element (40), the rocking element (40) being supported on the needle bed (1) with the bearing projection (21a), forming a fulcrum, the shank element (36) is guided to slide longitudinally on one (39) of the arms of the rocking element (40);

the sinker butt (18) cooperationg with the first sinker cam race (20) generates the longitudinal sliding movement of the sinkers; and wherein the sinker cam races (25, 26), generating the transverse movement of the sinkers are located above the auxiliary strips (9, 9') on both sides of the bearing projection (21a) forming the fulcrum and cooperate, respectively, with the shank element (36) and the rocking element (40).

2. Knitting machine according to claim 1, wherein each auxiliary strip (9) is positioned to rest laterally on the associated longitudinal rib (7) and is rigidly joined thereto.

3. Knitting machine according to claim 1, wherein the auxiliary strips are , in cross section wedge shaped strips (9') such that the needle guide slots or grooves (10) defined thereby have substantially parallel flanks.

4. Knitting machine according to claim 1, wherein the bearing projection (21*a*) has a circular bearing surface (22*a*), which, in the manner of a ball joint, engages a correspondingly shaped bearing recess (23*a*) of the needle bed (1).

5. Knitting machine according to claim 1, wherein the sinkers (5') are supported with their bearing projection (21*a*) on the bottom of a continuous groove (23*a*) formed in the needle bed (1) above the auxiliary strips (9) and extending along the needle bed.

* * * * *